United States Patent [19]

Morgenstern et al.

[11] Patent Number: 4,541,670

[45] Date of Patent: Sep. 17, 1985

[54] LUMBOSACRAL BACKREST WITH ADJUSTABLE CONTOUR

[75] Inventors: Robin Morgenstern, Chicago, Ill.; Edward W. Osann, Jr., Chesterton, Ind.

[73] Assignee: Robin Morgenstern, Chicago, Ill.

[21] Appl. No.: 523,660

[22] Filed: Aug. 15, 1983

[51] Int. Cl.[4] ..... A47C 3/00

[52] U.S. Cl. ..... 297/284; 297/460

[58] Field of Search ..... 297/284, 460; 5/436, 5/437

[56] References Cited

U.S. PATENT DOCUMENTS

| | | | |
|---|---|---|---|
| 2,843,195 | 7/1958 | Barvaeus | 297/284 |
| 3,890,000 | 6/1975 | Eagley | 297/284 |
| 4,239,282 | 12/1980 | White | 297/284 |
| 4,350,388 | 9/1982 | Weiner | 297/284 |
| 4,465,317 | 8/1984 | Schwarz | 297/284 |

FOREIGN PATENT DOCUMENTS

| | | | |
|---|---|---|---|
| 1182558 | 1/1959 | France | 297/284 |

*Primary Examiner*—Francis K. Zugel

*Attorney, Agent, or Firm*—Edward W. Osann, Jr.

[57] ABSTRACT

A lumbosacral backrest for use with chairs, beds and various other furniture, vehicle seats, and wheelchairs. The device, which may be portable or built-in, has an upstanding foundation frame of generally rectangular form, a yieldable back support on that frame, and a regulator spindle interposed between the frame and the yieldable back support. The regulator spindle is journalled for rotation longitudinally of the yieldable back support and may be stopped at any selected position within its range of rotational adjustment. This provides a transverse plane of rigidity across the back support at such selected position and thereby effects an adjustment in the contour of the back support. Adjustment of the regulator spindle may be accomplished manually or by power means.

18 Claims, 23 Drawing Figures

FIG. 1
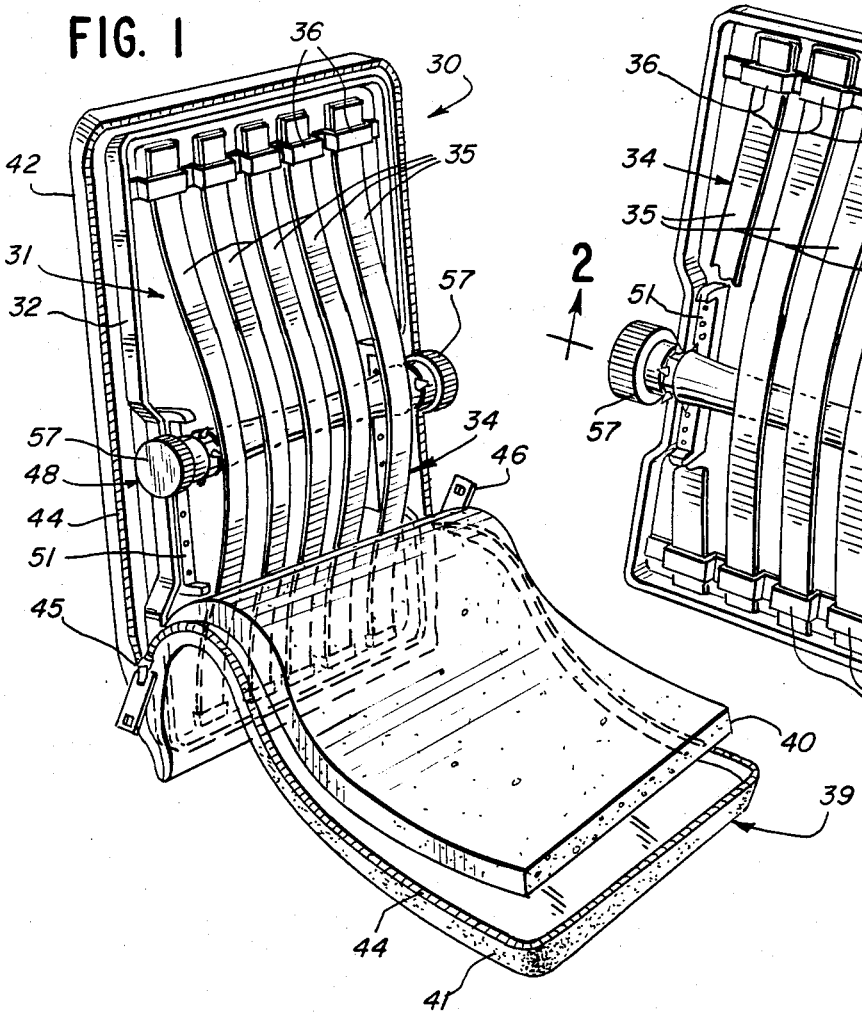
FIG. 1A
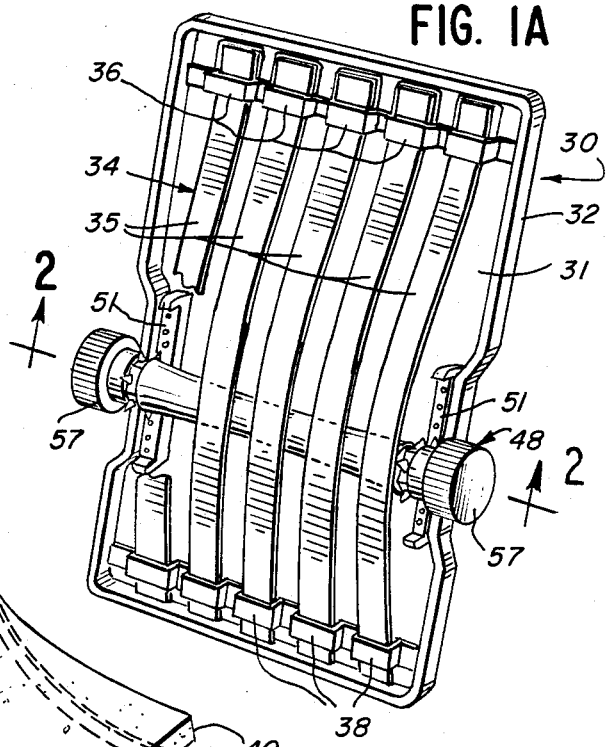
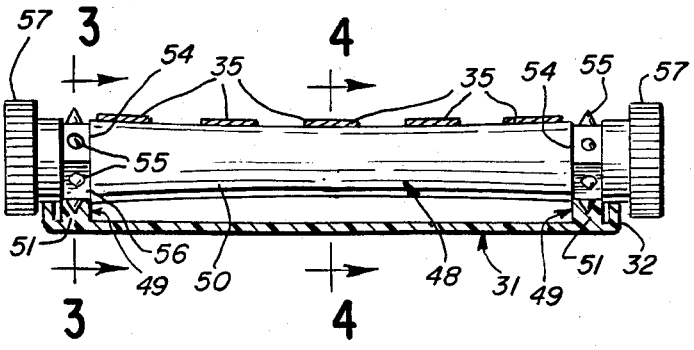
FIG. 2
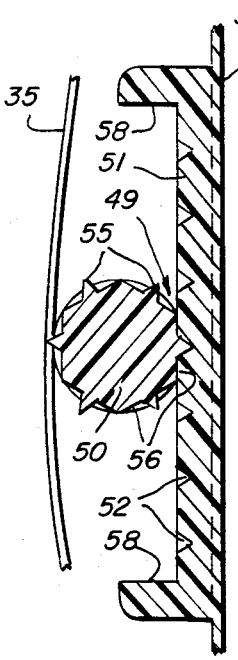
FIG. 3
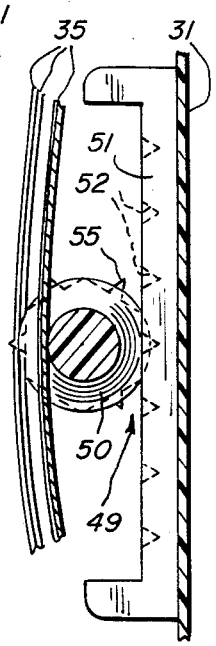
FIG. 4

FIG. 19
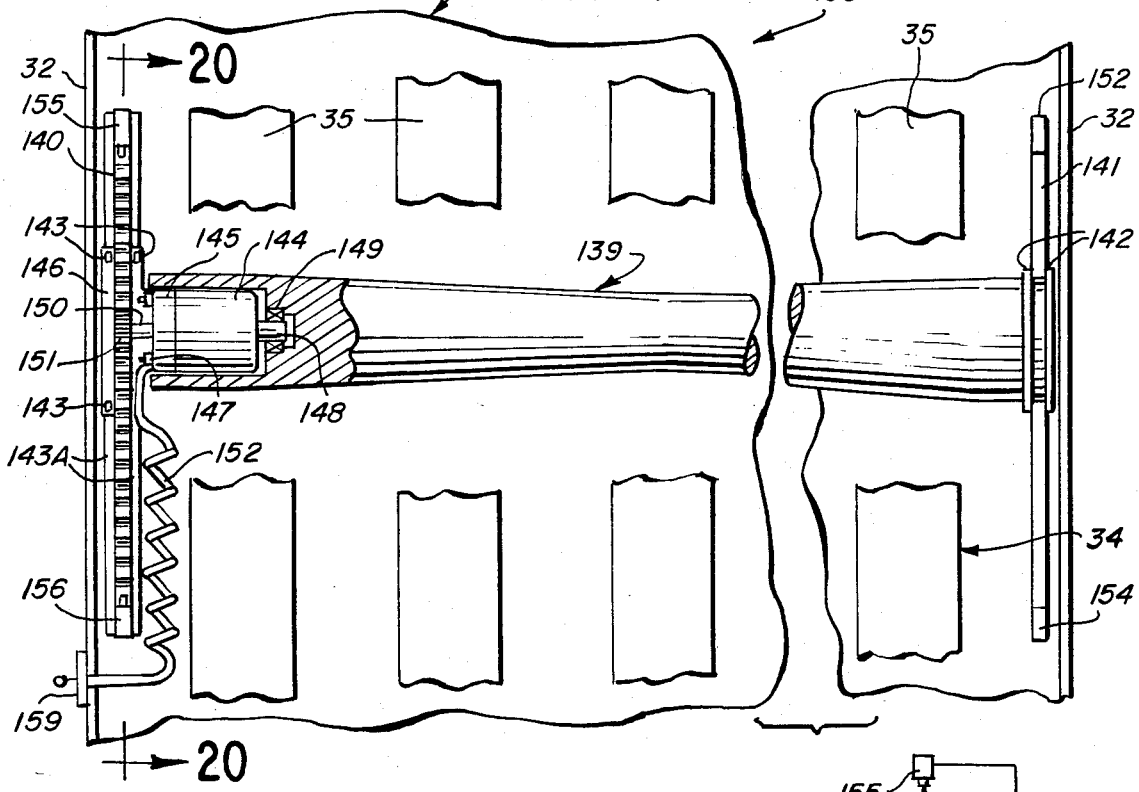
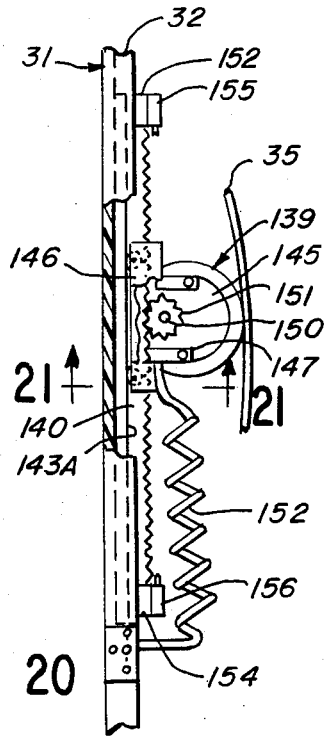
FIG. 20
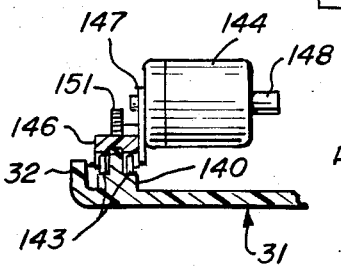
FIG. 21
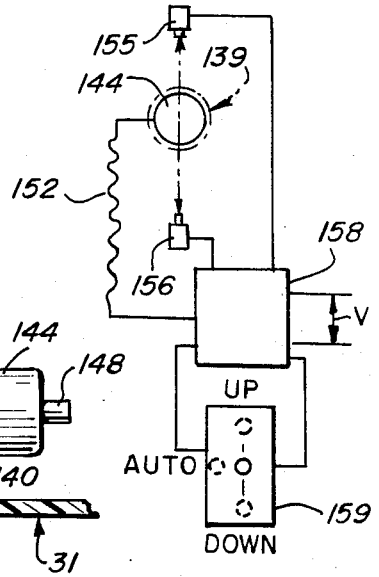
FIG. 22

LUMBOSACRAL BACKREST WITH ADJUSTABLE CONTOUR

The present invention relates to portable backrests for use with chairs, beds and other furniture, vehicle seats and wheelchairs. More specifically, the invention relates to a portable backrest of this nature having a novel means for adjusting its support contour to accommodate individual users with backs of various physical dimensions.

BACKGROUND OF THE INVENTION

The field of backrests has been the subject of developmental efforts for many years. This is due largely to the fact that back pain and back disorders afflict a major segment of the population.

The human spinal column is normally formed with an elongated S-shape which may vary both as to configuration and dimensions from one individual to another. For a number of reasons such as bad posture, poor sitting habits, or poor physical condition, the natural elongated S-shape of the spinal column may become distorted. When this occurs, abnormal concentrations of pressure occur on the vertebrae and the intervertebral discs. This, in turn, causes pressure on the nerves in the spinal cord frequently resulting in severe back pain, neck pain, fatigue and headaches. A well constructed backrest, properly adjusted, tends to restore the spinal S-curve to proper configuration and thereby relieves or avoids the uneven pressures which cause troublesome pain and fatigue.

The following prior art patents disclose a variety of backrests, some of which are portable and others of which are built into chairs or vehicle seats: U.S. Pat. Nos. 2,756,809—Endresen; 2,843,195—Barvaeus; 2,894,565—Conner; 3,642,319—Berchicci; 3,663,055—Gale; 3,762,769—Poschl; 3,990,742—Glass et al.; and 4,350,338—Weiner.

SUMMARY OF THE INVENTION

One object of the present invention is to provide a lumbosacral backrest having a back engaging contour which is adjustable and adapted to accommodate users' backs which vary widely in configuration and dimension.

Another object is to provide a backrest of the foregoing type which may be adjusted quickly and easily while in position behind the user. Such adjustment may be effected manually or by power.

A further object is to provide a backrest with a contour defined by a regulator spindle inserted between a foundation frame and a resilient back support, the regulator spindle being adjustable along the back support and adapted to define a transverse plane of rigidity at the proper level to provide comfortable support for the individual user's back.

Another object is to provide a backrest of the character set forth above which includes appropriate power means for massaging the sacral lumbar region of the back.

Still another object of the invention is to provide a backrest of the character set forth above which will be of simple, rugged construction, economical to manufacture, and require little if any maintenance.

The foregoing is accomplished by use of a regulator spindle interposed between the foundation frame and the resilient bowed back support in front of same, the regulator spindle being rotatably adjustable longitudinally of the back support and thereby defining a transverse plane of rigidity across the back support at any selected position of adjustment. The regulator spindle may be adjusted either manually or by power means.

BRIEF DESCRIPTION OF THE DRAWINGS

FIG. 1 is a perspective view of an illustrative portable backrest embodying the present invention, with the cover opened to show internal structure.

FIG. 1A is another perspective view of the adjustable backrest shown in FIG. 1 but with the outer cover and pad completely removed.

FIG. 2 is an enlarged sectional view taken axially of the regulator spindle in the plane of the line 2—2 in FIG. 1A.

FIGS. 3 and 4 are transverse sectional views taken in FIG. 2 through the regulator spindle and adjacent structure of the backrest in the planes of the lines 3—3 and 4—4, respectively.

FIG. 15 is a diagrammatic view of a control circuit for the backrest adjusting means of FIG. 12 and showing an enlarged elevational view of the control switch.

FIG. 19 is an enlarged fragmentary plan view, partly in section, illustrating still another form of backrest embodying the invention and having a power driven regulator spindle.

FIG. 20 is a transverse sectional view through the regulator spindle and associated rack shown in FIG. 19.

FIG. 21 is an enlarged fragmentary sectional view taken in the plane of the line 21—21 in FIG. 20.

FIG. 22 is a diagrammatic view illustrating the control circuit for the backrest adjusting means of FIGS. 19 and 20 and showing the face of the three position control switch.

DETAILED DESCRIPTION OF THE INVENTION

Figure 5:
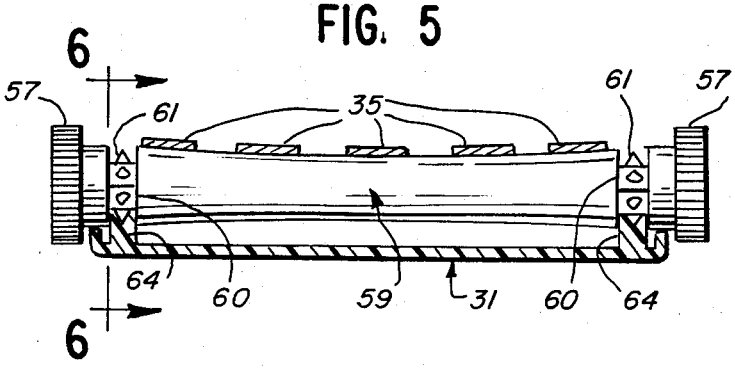
FIG. 5 is an axial sectional view similar to FIG. 2 but illustrating a modified form of regulator spindle also embodying the invention.

Referring more specifically to FIGS. 1-4, the invention is there exemplified in an illustrative lumbosacral backrest 30. The backrest 30 comprises an upstanding foundation frame 31 of generally rectangular form which may be fabricated from materials such as high strength plastic or a light metal stamping. The frame 31 happens to be formed with an out-turned peripheral margin comprising side edge portions 32 and end edge portions 33 bordering a generally flat panel having suitable stiffening ribs (not shown). The backrest 30 includes a yieldable back support 34 of somewhat greater length than the foundation frame 31 but connected thereto at its ends to define a resilient bowed configuration. The back support 34 comprises a series of laterally spaced bands 35 of spring steel or similar material. The upper end portions of the bands 35 are connected to the frame 31 by bracket 36 and the lower end portions are connected to the frame by brackets 38. The brackets 36 are spaced below the upper edge of the frame by an amount which is at least equal to the width of an individual band. This tends to create a moderate biasing force urging the bands 35 against the frame 31 and thus tending to shift the apex of their curvature to a point slightly below the horizontal center line of the frame. A contour adjusting means is interposed between the bowed spring bands 35 of the back support and the foundation frame 31 to adjust the contour of the back support longitudinally and transversely thereof.

The entire backrest 30 is enclosed within a cover 39 of upholstery fabric or other appropriate sheet material (FIG. 1). A resilient pad 40, of foam rubber or the like, is interposed between the outer faces of the back support bands 35 and the front panel 41 of the cover. The rear panel 42 of the cover encloses the rear face of the foundation frame 31 and may include straps for attaching the backrest to furniture or some other fixed support. The cover 39 is secured in place over the backrest 30 by means of a double zipper 44 which traverses the two sides and top of the backrest cover. The zipper 44 has two sliders 45, 46 operable independently of each other to permit access to the contour adjusting means.

In accordance with one aspect of the present invention, provision is made for adjusting the contour of the yieldable back support 34 by means of a regulator spindle 48 and an associated pair of rack and pinion mechanisms 49. The regulator spindle 48 comprises a body 50 of circular cross-section and an axial section of double concave form. Thus, the body has a minimum diameter at its center, tapering gently outward to a larger diameter adjacent each of its ends. This disposes the yieldable support bands 35 in a slightly concave orientation longitudinally of the spindle 48 and thereby provides a transverse plane of rigidity across the back support 34.

The rack and pinion mechanisms 49 are located with one adjacent each end of the adjusting spindle 48 (FIGS. 2-4). Each such mechanism comprises a rack 51 fixed upon or integrally molded with the foundation frame 31 and having a series of longitudinally spaced tooth recesses 52. Each rack 51 is spaced inwardly from the outturned side margin 32 of the foundation frame 31. The mechanism 49 also includes a pinion 54 having a plurality of teeth 55 adapted to mesh with the tooth recesses 52 in the rack. While the teeth 54 in this instance project slightly above the peripheral surface of the spindle 48, the user of the backrest 30 is not subjected to discomfort or annoyance because the foam rubber pad 40 covers the teeth and provides adequate cushioning to preclude any problem of interference with the use of the backrest.

In order to permit manual adjustment of the spindle 48 longitudinally of the back support 34 and its resilient bands 35, the ends of the spindle are extended slightly beyond the margins 32 of the frame 31 and provided with knurled adjusting knobs 56. To preclude interference with the outer cover 39, the sides of the frame 31 and their marginal edges 32 are indented slightly in the region of adjusting movement of the spindle 48. The overall length of the spindle, including the adjusting knobs 56, is accordingly limited to approximately the width of the non-indented portion of the sides of the frame 31. By reason of the foregoing construction, it will be appreciated that the adjusting spindle 48 may be rotatably adjusted into any selected one of a plurality of predetermined positions throughout its range of rotational movement. Each position of adjustment thus defines a transverse plane of rigidity across the back support at such selected position and thereby effects an adjustment in the contour of the back support.

To guard against an unintentional change in the position of adjustment of the spindle 48 due to movements of the user pressing against the back support 34, provision is made for locking the spindle 48 in a given position of adjustment until manually shifted to another position by the deliberate act of the user. This is accomplished by forming the pinion 54 as a polygon, in this instance a hexagon, with each tooth situated in one side of the polygon. Thus, when a tooth is engaged in a tooth recess of the rack, the polygon side associated with that tooth constitutes a locking face 56 which abuts solidly against the face of the rack 51. Due to the pressure applied by the outwardly bowed support bands 35 urging the spindle 48 against the racks 51, the spindle remains locked in position until sufficient torque is applied to the spindle 48 by the user to overcome the spring pressure of the overlying support bands 35.

In order to avoid inadvertent disengagement of the spindle 48 from the racks 51 as the spindle approaches each extreme of its rotational adjustment, a pair of stop abutments 58 is mounted at each end of at least one rack (FIG. 3). The abutments 58 are so proportioned that they will engage the spindle 48 diametrically when in the endmost positions along the rack 51.

Figure 6:
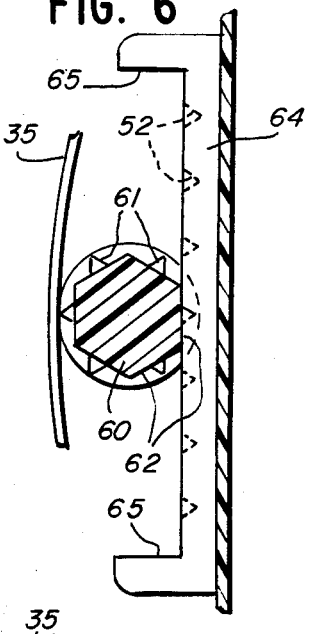
FIG. 6 is a transverse sectional view through the regulator spindle of FIG. 5, taken in the plane of the line 6—6.

Turning next to FIGS. 5 and 6, there is shown a modified form of regulator spindle 59 also embodying the present invention. The spindle 59 is closely similar to the regulator spindle 48 shown in FIGS. 1-4, the principal difference being that the pinion 60 of spindle 59 is smaller in diameter than that of spindle 48. The difference in diameter is sufficient to prevent the points of the teeth 61 of pinion 60 from projecting above the peripheral surface of the spindle 59.

Accidental movement of the spindle 59 out of a given position of adjustment is precluded by making each pinion 60 of polygonal cross-section, similar to the pinion 54 of spindle 48, with a flat locking face 62 adjacent each tooth 61. When a tooth 61 is engaged with a tooth recess in rack 64, the locking face 62 abuts against the opposed face of the rack until the user applies enough torque to overcome the frictional effect of the support bands 35. Movement of the spindle 59 beyond its associated racks 64 is precluded by stop abutments 65 at the ends of at least one rack.

Figure 7:
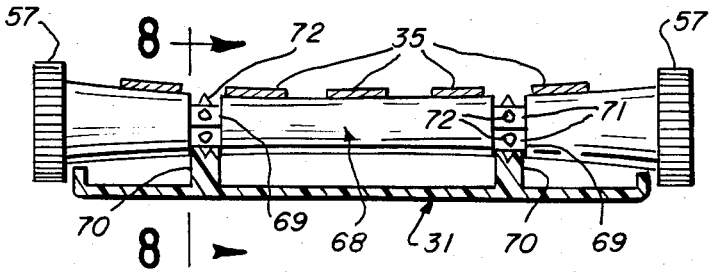
FIG. 7 is an axial sectional view similar to FIG. 5 but showing another modified form of regulator spindle also embodying the present invention.
Figure 8:
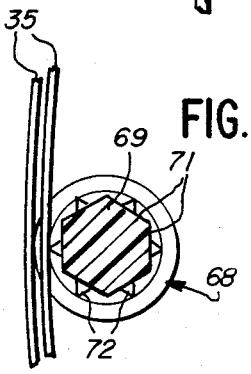
FIG. 8 is a transverse sectional view through the regulator spindle of FIG. 7, taken in the plane of the line 8—8.

FIGS. 7 and 8 illustrate another modified form of regulator spindle 68 embodying the present invention. The spindle 68 is closely similar to the spindle 59 described above. In this instance, however, the pinions 69 and their associated racks 70 are situated closer together along the axis of spindle 68, being located between an outermost band 35 and a next outermost band 35. The pinion teeth 72 do not project above the outer peripheral surface of the spindle 68. Locking faces 71 surrounding the respective teeth 72 serve to maintain the spindle 68 in a selected position of adjustment. At least one of the racks 70 has stop abuttments at its longitudinal extremities.

Figure 9:
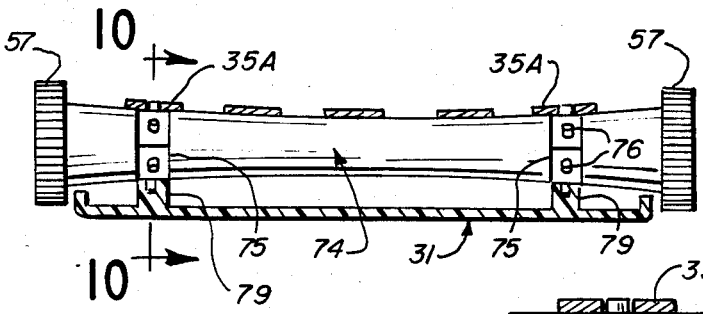
FIG. 9 is an axial sectional view similar to FIG. 7 but illustrating still another form of regulator spindle embodying the present invention.
Figure 10:
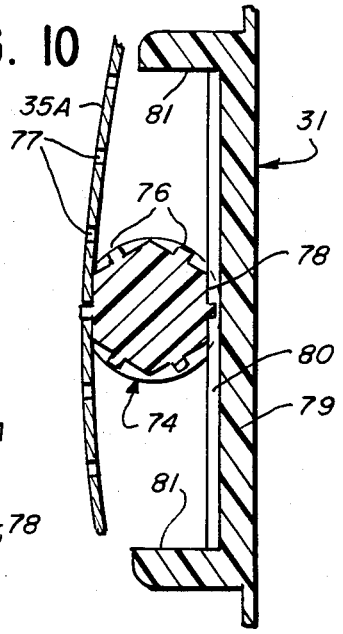
FIG. 10 is a transverse sectional view through the regulator spindle shown in FIG. 9, taken in the plane of the line 10—10.
Figure 11:
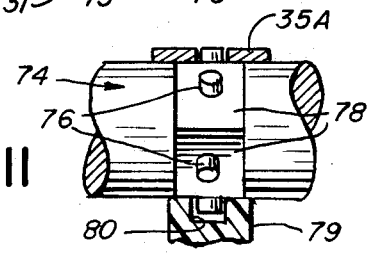
FIG. 11 is an enlarged fragmentary elevational view of a portion of the regulator spindle of FIG. 9, with certain related structure shown in transverse section.
Figure 12:
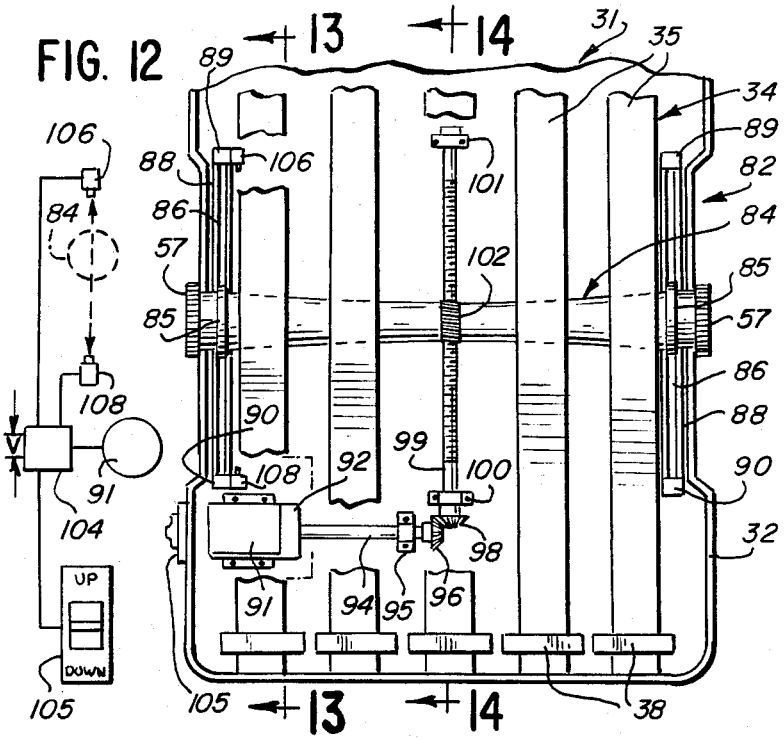
FIG. 12 is a fragmentary plan view illustrating a modified form of backrest also embodying the invention wherein the regulator spindle is adjusted by power means.
Figure 13:
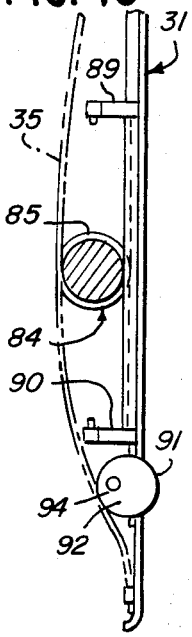
FIGS. 13 and 14 are transverse sectional views through the regulator spindle shown in FIG. 12, taken in the planes of the lines 13—13 and 14—14, respectfully.
Figure 14:
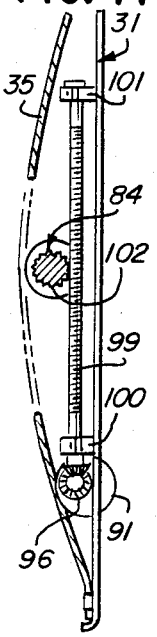

FIGS. 9–11 show still another modified form of regulator spindle 74 which also embodies the present invention. In this case, the regulator spindle 74 is fashioned with a pair of pinions 75 each having generally cylinderical teeth 76. The pinion 75 is of polygonal cross-section, defining a locking face 78 surrounding each tooth 76 similar to those described earlier herein. The rack for each pinion is defined by an overlying one of resilient back support bands 35A which has a series of longitudinally spaced holes 77 adapted for engagement by the pinion teeth 76. The latter have a height only slightly greater than the thickness of the Bands 35A. Instead of racks, the foundation frame 31 is formed with a pair of laterally spaced upstanding ribs 79 running lengthwise of the frame 31. The ribs 79 are disposed in alignment with the pinions 75 and each rib is formed with a longitudinal guideway 80 adapted to accommodate the pinion teeth 76. As indicated in FIG. 11, there is ample clearance between the guideway 80 and the pinion teeth 76. The spindle 74 is provided with adjusting knobs 57 and may be adjusted manually in the same manner as the spindles 48, 59 and 68. Stop abutments 81 may be situated at each end of one of the ribs 79 to prevent the spindle 74 from overtraveling.

Referring now to FIGS. 12–15, there is shown a backrest 82 similar to the backrest 30 described above and also embodying the present invention. In this instance, the backrest 82 has a power driven regulator spindle 84 for adjusting the contour of the yieldable back support 34. Except for certain modifications which will be noted herein, the general configuration of the spindle 84 is closely similar to that of the regulator spindles 48, 59, 68, and 74 described earlier herein. Instead of a rack and pinion connection with the foundation plate 31, the spindle 84 is formed with an annular wheel flange 85 adjacent each end thereof. Each wheel flange 85 is adapted to roll longitudinally along a guideway 86 formed in an upstanding rib 88 integral with, or fixed to, the foundation frame 31. The peripheral areas of the spindle 84 on either side of each wheel flange also roll on the upper faces of the ribs 88. The resilient bands 35 of the yieldable support member 34 bear against the peripheral surface of the regulator spindle 84. This maintains engagement between the wheel flanges 85 and guideways 86, and between the adjacent peripheral areas of the spindle 84 and the top surfaces of the ribs 88. Stop abutments 89, 90 are situated at the ends of the respective guideways 86 and ribs 88 to prevent overtravel of the spindle 84.

Provision is made in the backrest 82 for moving the regulator spindle 84 into any selected position within its range of rotational adjustment between the stops 89, 90. As in the case of the regulator spindles previously described, this provides a transverse plane of rigidity across the back support at the selected position and thereby adjusts the contour of the back support to accommodate the back of the individual user. In furtherance of such objective, a reversible electric motor 91, including a reduction gear 92, is secured to the foundation frame 31. In this instance, the motor and reduction gear housing may be mounted so as to project a slight amount through the main panel area of the foundation frame 31, thus providing the necessary clearance with the resilient support bands 35. Output shaft 94 of the reduction gear extends from the latter through a bearing 95 fixed to the frame 31 and terminates in a bevel pinion 96. The latter drivingly meshes with a pinion 98 fixed to worm shaft 99 extending transversely of the spindle 84. The worm shaft 99 is journalled for rotation in a pair of bearings 100, 101 fixed to the frame 31. In order to receive power from the worm shaft 99, the spindle 84 is formed with a centrally mounted worm wheel 102 which drivingly meshes with the shaft 99. Since a worm wheel drive is inherently self-locking, no additional locking means need be provided to constrain the spindle 84 against movement when in a selected position of adjustment.

Operation of the motor driven adjustment means for the spindle 84 will become more apparent from the diagram of the control system in FIG. 15. Accordingly, it will be noted that the motor 91 is connected to a conventional motor controller 104 which is powered from an external power source indicated by the letter "V". Control switch 105, which is mounted on the lower right-hand side of the backrest 82 is connected directly to the motor controller 104. Upper limit switch 106, mounted on abutment 89, and lower limit switch 108, mounted on abutment 90, are each connected to the motor controller 104. With the spindle 84 in the position shown in FIG. 12, shifting the slider of switch 105 to the "UP" position will cause the motor to drive the spindle 84 upwardly. Release of the slider back to neutral position will cause the spindle to stop in the selected position. In the event, however, that the slider of switch 105 should be held in the "UP" position long enough to drive the spindle 84 against the upper stop abutments 89, the upper limit switch 106 becomes actuated to de-energize the motor 91. At that point, the only operative position of the switch 105 will be the "DOWN" position. Conversely, if the spindle 84 should be driven down to the lower stop abutments 90 so as to actuate the lower limit switch 108, power to drive the motor 91 downwardly will be cut off and the only operative position of the switch 105 will be the "UP" position.

With the motor 91 de-energized, it would be possible to adjust the position of the regulator spindle 84 manually by turning either or both adjusting knobs 57. With sufficient torque applied manually to overcome the friction produced by overlyihg bands 35, the worm wheel will readily roll along the worm shaft 90 and remain engaged therewith.

Figure 16:
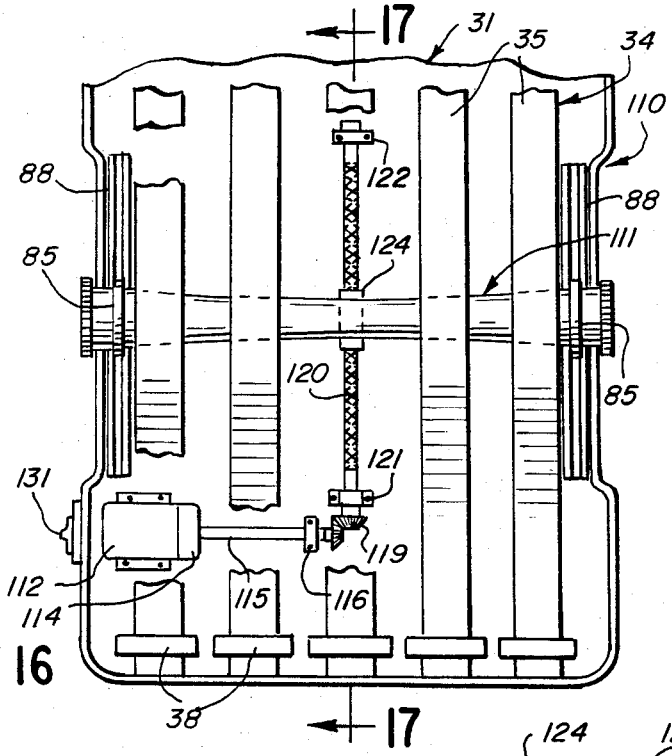
FIG. 16 is a fragmentary plan view of another form of backrest embodying the invention and utilizing a power driven regulator spindle.
Figure 17:
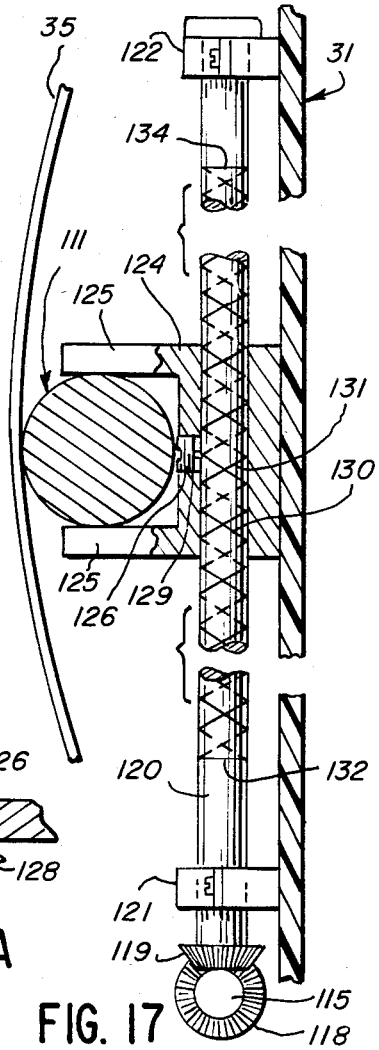
FIG. 17 is an enlarged fragmentary longitudinal sectional view through the drive mechanism associated with the regulator spindle, taken in the plane of the line 17—17 in FIG. 16.
Figure 18:
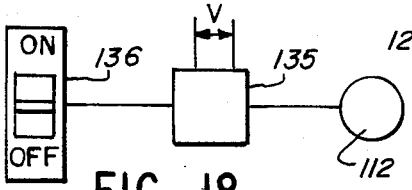
FIG. 18 is a diagrammatic view of a control circuit for the backrest adjusting means of FIG. 16 and showing an enlarged elevational view of the control switch.

Turning next to FIGS. 16–18, another aspect of the present invention is there shown in an illustrative backrest 110. The latter is closely similar to the backrest 82 described above from the standpoint of the foundation frame 31, the back support member 34 defined by resilient bands 35, and a regulator spindle 111 identical to the spindle 84 except for elimination of the worm wheel 102. The backrest 110 differs from the backrest 82 in that the primary purpose of the backrest 110 is to serve as a power driven device for massaging the sacral lumbar region of the back.

In furtherance of the foregoing objective, the backrest 110 is equipped with a unidirectional motor 112, including a reduction gear 114, mounted on the foundation frame 31 in the same manner as the motor 91 referred to above. The reduction gear 114 has an output shaft 115 which passes through a fixed bearing 116 on the frame 31 and terminates in a bevel pinion 118. The latter drivingly meshes with a bevel pinion on the end of a dual threaded shaft 120 extending along the center line of the frame 31. The shaft 120 is journalled in fixed bearings 121, 122 attached to the frame 31 and passes transversely under the regulator spindle 111. A follower 124 is slideably mounted upon the shaft 120 and driven axially thereof by the latter. The follower is formed with a pair of upstanding arms 125 which straddle the central portion of the regulator spindle 111 and transmit power thereto from the shaft 120.

Figure 17A:
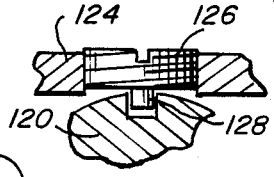
FIG. 17A is an enlarged fragmentary sectional view detailing the follower key and pin and their engagement with the dual threaded drive shaft.

The dual threaded shaft 120 is adapted to reciprocate the follower 124 between the bearings 121, 122 as the shaft 120 rotates unidirectionally. To do this, the shaft 120 is formed with two intersecting threads of opposite hand but equal pitch (FIG. 17). The threads are connected at or near each end of the shaft 120. A follower key 126 in the form of a short screw with a projecting pin 128 at its lower end is threadedly engaged in a tapped bore 129 in the upper central portion of the follower (FIGS. 17, 17A). The pin 128 is of appropriate length and diameter to engage either one of the dual threads 130, 131 of the shaft 120.

Assuming that the shaft 120 is turning in a clockwise direction, when viewed from the end of pinion 119, and that the pin 128 of the follower key is engaged with the thread 130, the follower 124 will be driven toward the pinion end of the shaft 120. When the follower 124 reaches the end of the thread 130, with the shaft still rotating clockwise, the pin 128 will cross over from the thread 130 to the thread 131 via the connecting shunt 132. With the shaft 120 still rotating in a clockwise direction, the follower pin 128 will enter the thread 131, reversing the follower 124 and driving it toward the bearing 122. When the follower pin 128 reaches the end of the thread 131, it crosses over to the thread 130 via shunt 134, reversing the follower 124 and driving it toward the bearing 121.

FIG. 18 is a diagramatic view of the control system of backrest 110. The motor 112 is connected to conventional motor controller 135 which is energized from an external power source "V". On-off switch 136, mounted on the lower right-hand side of the backrest 110, is connected directly to the controller 135. With the switch in the "ON" position, the regulator spindle 111 will be reciprocated between the bearings 121, 122, changing the contour of the support member 34 in a timed cycle appropriate for lower back massage. Since the spindle 111 remains positively connected to its mechanical drive and the reversals in its direction of movement are effected by the mechanical drive, no stops are needed at the ends of the ribs 88.

FIGS. 19–22 depict still another power adjusted backrest 138 also embodying the present invention. The basic structure of the backrest 138 is similar to that of the backrests 82 and 110 described above. The differences reside primarily in the construction of the regulator spindle 139 and the related guide structure on the foundation frame 31.

The regulator spindle 139 is similar in general shape to the spindles 84 and 111 previously described. Its longitudinal cross-section has a double concave shape for cooperation with the resilient bands 35 of the back support 34. The spindle 139 is supported and guided throughout its range of rotational adjustment by means of a rack 140 spaced inwardly from the left side margin of the frame 31, and an upstanding rib 141 spaced inwardly from the right side margin of the frame (as viewed in FIG. 19). The right-hand end portion of the spindle 139 is formed with a pair of flanges 142 which straddle the rib 141 and maintain engagement between the latter and the spindle.

The left-hand end portion of the spindle 139 telescopically receives a drive motor 144 and reduction gear 145. The common housing of the motor and reduction gear 144, 145 is fixed to a sliding base 146 as by means of brackets 147 and is thereby restrained against rotation. The base 146 straddles the rack 140 and is adapted for reciprocating movement therealong (FIGS. 19–21). The inner end of the housing of motor 144 has a fixed boss 148 extending axially therefrom. The boss 148 carries a bearing 149 recessed in the spindle 139 and which supports the left-hand end portion of the latter for rotation about the housing of the motor and reduction gear 144, 145. The reduction gear has an output shaft 150 carrying a drive pinion 151 which meshes with the rack 140. Power from an outside source is supplied to the motor 144 via a coiled elastic lead 152.

Since the motor 144 is reversible, it is adapted to traverse the spindle 139 in either direction longitudinally of the rack 140 and the rib 141. In the course of such action, the body of the spindle 139 is rotated as the motor 144, reduction gear 145 and sliding base 146 are reciprocated along the rack 140. In order to reduce frictional drag and wear between these members, the sliding base 146 is fashioned with rollers 143, in this case arranged in two pairs adjacent opposite ends of the base 146. The rollers 143 straddle the rack 140 and ride upon a pair of integral shoulders 143A extending the full length of the rack (FIG. 20, 21). To preclude overtravel, upper and lower stop abutments 152, 154 are fixed to the ends of the rib 141 and the rack 140. In addition, upper and lower limit switches 155, 156 are fixed to the respective stop abutments 152, 154 on the rack 140.

The operation of the power adjustment means associated with the regulator spindle 139 will be better understood upon reference to the diagram of the control system in FIG. 22. The reversible motor 144, nested within one end of the spindle 139, is connected via a coiled resilient lead 152 to conventional motor controller 158. The latter is powered from an external source designated by the letter "V". A three-way control switch 159, mounted on the lower right-hand side of the backrest 138, is connected to the motor controller 158 by two separate lines. Upper limit switch 155, located at the upper end of the rack, and lower limit switch 156, at the lower end of the rack, are each connected to the motor controller 158. With the spindle 139 in the position shown in FIG. 19, shifting the operating lever of switch 159 to the "UP" position will cause the motor 144 to drive the spindle upwardly. Release of the operating lever to the middle or neutral position will cause the spindle to stop in any selected position. Shifting the operating lever of the switch 159 to the "DOWN" position will cause the motor 144 to drive the spindle 139 downwardly, while return of the operating lever to neutral position will cause the spindle to stop. As in the case of the control system for the spindle 84 shown in FIG. 15, holding the operating lever in the "UP" position until the upper limit switch 155 is actuated by the sliding base 146 will de-energize the motor 144. It then becomes necessary to move the operating lever to the "DOWN" position which will result in moving the spindle 139 downwardly. In like manner, if the downward movement is continued until the lower limit switch 156 is actuated, the motor will be de-energized and it will be necessary to shift the lever to the "UP" position to move the spindle upwardly.

In addition to the motions described in the previous paragraph, the operating lever of the control switch 159 has an "AUTO" position, the function of which is to drive the regulator spindle 139 upwardly and downwardly in a timed cycle. This causes the contour of the back support bands 35 to go through the necessary cyclic changes in contour to perform a lower back massage. The foregoing arrangement thus achieves the dual purpose of power adjustment of the regulator spindle 139 to any given position within its operating range, and automatic reciprocation of the spindle in a timed cycle through its operating range for back massage.

We claim as our invention:

1. A lumbosacral backrest for use with chairs, beds and other furniture, vehicle seats, and wheelchairs, comprising, in combination:

(a) an upstanding foundation frame having a pair of side edge portions and a pair of end edge portions;

(b) a flexible back support fastened to said foundation frame in outwardly bowed relation therewith;

(c) a regulator spindle having a longitudinal cross-section of double concave form, and said flexible back support conforming to that form, disposed transversely of said foundation frame and said flexible back support and interposed therebetween to provide a transverse plane of rigidity across said back support;

(d) means situated adjacent to but inboard of said side edge portions journaling said regulator spindle for rotational movement longitudinally of the bow in said flexible back support; and (e) means for adjustably positioning said regulator spindle in any selected position within its range of rotational movement longitudinally of said bow to define and locate said transverse plane of rigidity across said back support at such selected position and thereby effect an adjustment in the contour of said back support.

2. A lumbosacral backrest for use with chairs, beds and other furniture, vehicle seats, and wheelchairs, comprising, in combination:

(a) an upstanding foundation frame;

(b) a flexible back support fastened to said foundation frame in outwardly bowed relation therewith;

(c) a regulator spindle disposed transversely of said foundation frame and said flexible back support and interposed therebetween to provide a transverse plane of rigidity across said back support;

(d) means journaling said regulator spindle for rotational movement longitudinally of the bow in said flexible back support; and (e) means for adjustably positioning said regulator spindle in any selected position within its range of rotational movement longitudinally of said bow to define said transverse plane of rigidity across said back support at such selected position and thereby effect an adjustment in the contour of said back support.

(f) said spindle having a longitudinal cross-section of double concave form and said flexible back support conforming to that form.

3. A lumbosacral backrest for use with chairs, beds and other furniture, vehicle seats, and wheelchairs, comprising, in combination:

(a) an upstanding foundation frame;

(b) a flexible back support fastened to said foundation frame in outwardly bowed relation therewith;

(c) a regulator spindle disposed transversely of said foundation frame and said flexible back support and interposed therebetween to provide a transverse plane of rigidity across said back support;

(d) means journaling said regulator spindle for rotational movement longitudinally of the bow in said flexible back support;

(e) said back support comprising a plurality of resilient bands which frictionally engage the peripheral surface of said spindle; and (f) means for adjustably positioning said regulator spindle in any selected position within its range of rotational movement longitudinally of said bow to define said transverse plane of rigidity across said back support at such selected position and thereby effect an adjustment in the contour of said back support;

(g) said spindle having a longitudinal cross-section of double concave form and said flexible back support conforming to that form.

4. A lumbosacral backrest for use with chairs, beds and other furniture, vehicle seats, and wheelchairs, comprising, in combination:

(a) an upstanding foundation frame;

(b) a flexible back support fastened to said foundation frame in outwardly bowed relation therewith;

(c) a regulator spindle disposed transversely of said foundation frame and said flexible back support and interposed therebetween to provide a transverse plane of rigidity across said back support;

(d) means journaling said regulator spindle for rotational movement longitudinally of the bow in said flexible back support;

(e) said back support comprising a plurality of resilient bands which frictionally engage the peripheral surface of said spindle;

(f) means for adjustably positioning said regulator spindle in any selected position within its range of rotational movement longitudinally of said bow to define said transverse plane of rigidity across said back support at such selected position and thereby effect an adjustment in the contour of said back support;

(g) said spindle having a longitudinal cross-section of double concave form and said flexible back support conforming to that form;

(h) said backrest being provided with a cover of flexible sheet material such as fabric having a front panel and a rear panel, and a resilient pad of foam material or other material with similar resilient properties is interposed between said back support bands and the front panel of said cover.

5. A lumbosacral backrest for use with chairs, beds, vehicle seats, and wheelchairs, comprising, in combination:

(a) an upstanding foundation frame;

(b) a flexible back support fastened to said foundation frame in outwardly bowed relation therewith;

(c) a regulator spindle disposed transversely of said foundation frame and said flexible back support and interposed therebetween to provide a transverse plane of rigidity across said back support;

(d) means journaling said regulator spindle for rotational movement longitudinally of said flexible back support and in frictional engagement therewith;

(e) manually actuated means for adjustably positioning said regulator spindle in any selected position within its range of rotational movement longitudinally of said flexible back support to define a transverse plane of rigidity across said back support at such selected position and thereby effect an adjustment in the contour of said back support; and (f) said spindle having a longitudinal cross-section of double concave form and said flexible back support conforming to that form in each said selected position.

6. A backrest as set forth in claim 5, wherein said manually actuated means for adjustably positioning said regulator spindle comprises at least one rack fixed to said foundation frame, and at least one pinion fixed to said regulator spindle for toothed engagement with said rack.

7. A backrest as set forth in claim 5, wherein said manually actuated means for adjustably positioning said regulator spindle comprises a pair of racks fixed in laterally spaced relation on said foundation frame, and a pair of pinions spaced axially on said regulator spindle for engagement with said pair of racks.

8. A backrest as set forth in claim 7, wherein each said pinion has teeth which project above the peripheral surface of said spindle.

9. A backrest as set forth in claim 7, wherein each said pinion has teeth which do not project above the peripheral surface of said spindle.

10. A backrest as set forth in claim 6, wherein said pinion is fashioned in polygonal cross-section with a tooth projecting generally radially from each side of the polygon; the area of each polygon side adjacent a corresponding tooth serving as a locking face when said tooth is in engagement with a tooth recess in said rack.

11. A backrest as set forth in claim 5, wherein said back support comprises a plurality of resilient bands which frictionally engage the peripheral surface of said spindle; said manually actuated means for adjustably positioning said regulator spindle comprises at least one rack defined by a series of perforations in at least one said resilient band; said manually actuated means further comprises at least one pinion on said regulator spindle having teeth adapted to engage said rack; and an upstanding rib fixed to said foundation frame engages said spindle in opposition ot said rack, said rib having a longitudinal clearance groove for accommodating said pinion teeth.

12. A lumbosacral backrest for use with chairs, beds, vehicle seats, and wheelchairs, comprising, in combination;

(a) an upstanding foundation frame;

(b) a flexible back support fastened to said foundation frame in outwardly bowed relation therewith;

(c) a regulator spindle disposed transversely of said foundation frame and said flexible back support and interposed therebetween to provide a transverse plane of rigidity across said back support;

(d) said regulator spindle having a longitudinal cross-section of double concave form and said flexible back support conforming to that form;

(e) means supporting said regulator spindle for rotational movement longitudinally of said flexible back support and in frictional engagement therewith; and (f) power actuated means connected to said regulator spindle for adjustably positioning said spindle in any selected position within its range of rotational movement longitudinally of said flexible back support to define a transverse plane of rigidity across said back support at such selected position and thereby effect an adjustment in the contour of said back support.

13. A backrest as set forth in claim 12, wherein said power actuated means includes:

(a) a reversible motor mounted on said foundation frame;

(b) a worm shaft journaled on said foundation frame and disposed transversely of said regulator spindle, said worm shaft being driven by said motor;

(c) a worm wheel fixed on said spindle and disposed for driving engagement by said worm shaft;

(d) a motor controller; and (e) a motor control switch for actuating said motor through said controller to adjustably position said spindle in any selected position within its range of rotational movement.

14. A backrest as set forth in claim 13, including:

(a) said spindle supporting means including longitudinal guideways on said foundation frame;

(b) a pair of stop abutments at the extremities of said guideways;

(c) a pair of limit switches fixed to said pair of stop abutments;

(d) a motor controller connected to said limit switches and to said motor; and (e) a manually actuated directional control switch connected to said motor controller.

15. A backrest as set forth in claim 12, wherein said power actuated means includes:

(a) a motor mounted on said foundation frame;

(b) a dual threaded shaft journaled on said foundation frame and driven by said motor, said shaft being disposed transversely of said regulator spindle;

(c) a reversible follower drivingly connected to said dual threaded shaft for reciprocation thereon;

(d) means on said follower drivingly connecting same with the central portion of said spindle;

(e) a motor controller; and (f) a motor control switch for actuating said motor through said controller to reciprocate said regulator spindle in a timed cycle for lower back massage.

16. A backrest as set forth in claim 12, wherein said power actuated means includes:

(a) a rack fixed to said foundation frame adjacent one side edge portion thereof;

(b) an upstanding rib fixed to said foundation frame adjacent the opposite side edge portion thereof;

(c) one end of said regulator spindle being supported for rotational movement along said rack and the other end being supported for rotational movement along said rib;

(d) a reversible motor housed within a recess in said end of said spindle adjacent said rack;

(e) bearing means interposed between the housing of said motor and said spindle permitting rotation of said spindle relative to said motor housing;

(f) a sliding base mounted for reciprocating movement along said rack;

(g) said motor housing being fixed to said sliding base and having an output pinion drivingly meshing with said rack for reciprocating said sliding base and rotating said spindle relative to said rack and said rib;

(h) a motor controller connected to said motor; and (i) a motor control switch for actuating said motor through said controller to adjustably position said spindle at any selected position within its range of rotational movement.

17. A backrest as set forth in claim 16, including:

(a) a pair of stop abutments at the extremities of said rack;

(b) a pair of limit switches fixed to respective ones of said stop abutments and engageable by said sliding base, said limit switches being connected to said motor controller;

(c) a manually actuated two position directional control switch adapted upon actuation of one of said limit switches to be rendered ineffective for moving said regulator spindle in the direction of said actuated limit switch, while remaining effective to move said spindle in the opposite direction.

18. A backrest as set forth in claim 17, wherein said motor control switch has a third position for actuating said motor through said motor controller to reciprocate said sliding base, said motor, and said regulator spindle in a timed cycle for lower back massage.

* * * * *